US010260192B2

(12) United States Patent
Yu et al.

(10) Patent No.: US 10,260,192 B2
(45) Date of Patent: Apr. 16, 2019

(54) TOP-LOADING-TYPE WASHING MACHINE

(71) Applicant: LG ELECTRONICS INC., Seoul (KR)

(72) Inventors: Insik Yu, Seoul (KR); Youngjong Kim, Seoul (KR); Kyubum Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 14 days.

(21) Appl. No.: 15/281,787

(22) Filed: Sep. 30, 2016

(65) Prior Publication Data

US 2017/0096766 A1 Apr. 6, 2017

(30) Foreign Application Priority Data

Oct. 2, 2015 (KR) ..... 10-2015-0139269
Oct. 2, 2015 (KR) ..... 10-2015-0139273

(51) Int. Cl.

| | |
|---|---|
| ***D06F 37/40*** | (2006.01) |
| ***D06F 37/12*** | (2006.01) |
| ***D06F 37/26*** | (2006.01) |
| ***D06F 39/00*** | (2006.01) |
| ***D06F 39/08*** | (2006.01) |
| *D06F 17/08* | (2006.01) |

(Continued)

(52) U.S. Cl.

CPC ..... *D06F 37/40* (2013.01); *D06F 37/12* (2013.01); *D06F 37/268* (2013.01); *D06F 37/269* (2013.01); *D06F 39/005* (2013.01); *D06F 39/083* (2013.01); *D06F 39/088* (2013.01); *D06F 17/08* (2013.01); *D06F 17/10* (2013.01); *D06F 23/04* (2013.01)

(58) Field of Classification Search

CPC ..... D06F 37/40; D06F 39/088; D06F 37/269; D06F 39/005; D06F 37/268; D06F 37/12; D06F 39/083; D06F 23/04; D06F 17/10; D06F 17/08

See application file for complete search history.

(56) References Cited

U.S. PATENT DOCUMENTS

| | | | | |
|---|---|---|---|---|
| 5,661,990 | A | 9/1997 | Chong | |
| 2005/0166643 | A1* | 8/2005 | Cho | D06F 37/304 68/12.02 |
| 2014/0109627 | A1* | 4/2014 | Lee | D06F 17/08 68/133 |

FOREIGN PATENT DOCUMENTS

| | | |
|---|---|---|
| CN | 201027257 Y | 2/2008 |
| CN | 202705734 U | 1/2013 |

(Continued)

*Primary Examiner* — Michael E Barr
*Assistant Examiner* — Cristi J Tate-Sims
(74) *Attorney, Agent, or Firm* — Dentons US LLP

(57) ABSTRACT

A top-loading-type washing machine including a drum, a drive module for rotating the drum via a drive shaft, inner and outer pulsators placed in the drum to be rotated in opposite directions, and a gearbox connected to the drive shaft for rotating both the pulsators. The gearbox includes a sun gear rotatably connected to the drive shaft, planetary gears rotatably engaged with the sun gear, a ring gear rotatably engaged with the planetary gears, and a carrier for connecting the planetary gears so as to be rotated along with the planetary gears. The washing machine achieves excellent washing performance via rotation of the pulsators in opposite directions and variable speeds of the pulsators relative to the drum depending on the size of the laundry load.

19 Claims, 8 Drawing Sheets

(51) Int. Cl.
*D06F 17/10* (2006.01)
*D06F 23/04* (2006.01)

(56) References Cited

FOREIGN PATENT DOCUMENTS

| | | | |
|---|---|---|---|
| EP | 1439255 | A1 | 7/2004 |
| JP | 5079667 | B2 | 11/2012 |
| JP | 2015062583 | A | 4/2015 |
| KR | 200327068 | | 9/2003 |
| KR | 1020140051664 | A | 5/2014 |

* cited by examiner

TOP-LOADING-TYPE WASHING MACHINE

CROSS-REFERENCE TO RELATED APPLICATION

This application claims the priority benefit of Korean Patent Application No. 10-2015-0139269, filed on Oct. 2, 2015 and Korean Patent Application No. 10-2015-0139273 filed on Oct. 2, 2015 in the Korean Intellectual Property Office, the disclosure of each is incorporated herein by reference.

BACKGROUND

1. Field

The present disclosure relates to a top-loading-type washing machine having pulsators.

2. Description of the Related Art

Generally, a washing machine is an apparatus that washes laundry using, for example, de-emulsification of detergent, a water stream generated by rotation of a wash tub or a wash blade, and shocks applied by the wash blade, and performs washing, rinsing, or dehydration to remove contaminants adhered to laundry (hereinafter also referred to as "fabric") using the action of detergent and water.

A conventional top-loading-type washing machine includes a pulsator placed inside a drum.

The pulsator may be rotated independently of the drum. A conventional pulsator may be rotated along with the drum, or may be rotated in the opposite direction as the drum.

When the drum and the pulsator are rotated in opposite directions, power consumption is high, but the washing force that is exhibited is not commensurate with the amount of power that is consumed.

SUMMARY

It is one object of the present disclosure to provide a top-loading-type washing machine in which two pulsators are installed.

It is another object of the present disclosure to provide a top-loading-type washing machine in which an inner pulsator and an outer pulsator are installed.

It is another object of the present disclosure to provide a top-loading-type washing machine in which an inner pulsator and an outer pulsator may be rotated in opposite directions.

It is another object of the present disclosure to provide a top-loading-type washing machine in which only relative speeds between an inner pulsator and an outer pulsator are determined, and relative speeds between each of the inner and outer pulsators and a drum are not determined.

It is another object of the present disclosure to provide a top-loading-type washing machine which exhibits low power consumption during the operation of an inner pulsator and an outer pulsator.

It is a further object of the present disclosure to provide a top-loading-type washing machine in which the rotation speeds of an inner pulsator and an outer pulsator are variable depending on the size of the laundry load.

In accordance with an aspect of the present disclosure, the above and other objects can be accomplished by the provision of a top-loading-type washing machine including a drum in which vertically introduced laundry is loaded, a drive module for rotating the drum via a drive shaft, an inner pulsator placed in the drum and located on the drive shaft, the inner pulsator being rotated by torque from the drive module, an outer pulsator placed in the drum and located at an outer side of the inner pulsator, the outer pulsator being rotated in a direction opposite to that of the inner pulsator by torque from the drive module, and a gearbox connected to the drive shaft so as to receive torque from the drive module, the gearbox rotating the inner pulsator and the outer pulsator in opposite directions. The gearbox includes a sun gear connected to and rotating with the drive shaft, a plurality of planetary gears engaged with the sun gear, each of the planetary gears rotating on its own axis while traveling along an outer circumferential surface of the sun gear, a carrier for providing the rotation axis of each planetary gear and connecting the planetary gears to one another, the carrier being rotated along with the planetary gears when the planetary gears travel along the outer circumferential surface of the sun gear, and a ring gear engaged with the planetary gears so as to rotate. One of the inner pulsator and the outer pulsator is connected to the carrier so as to rotate at the same speed and direction as the carrier, and a remaining one of the inner pulsator and the outer pulsator is connected to the ring gear so as to rotate at the same speed and direction as the ring gear. The planetary gears, the carrier, and the ring gear, excluding the sun gear, are arranged in a free state. The planetary gears, the carrier, and the ring gear are arranged so as to be rotatable relative to the drum.

In a first embodiment of the present invention, the inner pulsator may be connected to the carrier so as to rotate at the same speed and direction as the carrier, and the outer pulsator may be connected to the ring gear so as to rotate at the same speed and direction as the ring gear. Specifically, the gearbox may include a gear housing to which the ring gear is fixed. The inner pulsator may be connected to the carrier so as to rotate, and the outer pulsator may be connected to the gear housing so as to rotate.

In a second embodiment of the present invention, the outer pulsator may be connected to the carrier so as to rotate at the same speed and direction as the carrier, and the inner pulsator may be connected to the ring gear so as to rotate at the same speed and direction as the ring gear. Specifically, the gearbox may include a ring gear shaft formed on the ring gear and coupled to the inner pulsator, and a gear housing to which the carrier is fixed. The inner pulsator may be connected to the ring gear shaft so as to rotate, and the outer pulsator may be connected to the gear housing so as to rotate.

BRIEF DESCRIPTION OF THE DRAWINGS

The above and other objects, features and other advantages of the present invention will be more clearly understood from the following detailed description taken in conjunction with the accompanying drawings, in which:

The following description will be based on the embodiments of the present invention, i.e. the first embodiment and the second embodiment. FIGS. 1 and 2 are views illustrating common elements of the first embodiment and the second embodiment, FIGS. 3 to 5 are views illustrating the configuration of the first embodiment, and FIGS. 6 to 9 are views illustrating the configuration of the second embodiment. Elements designated by reference numerals with single quotation marks (') appended thereto mean that they are elements of the second embodiment, which are different from elements of the first embodiment.

DETAILED DESCRIPTION

Figure 1:
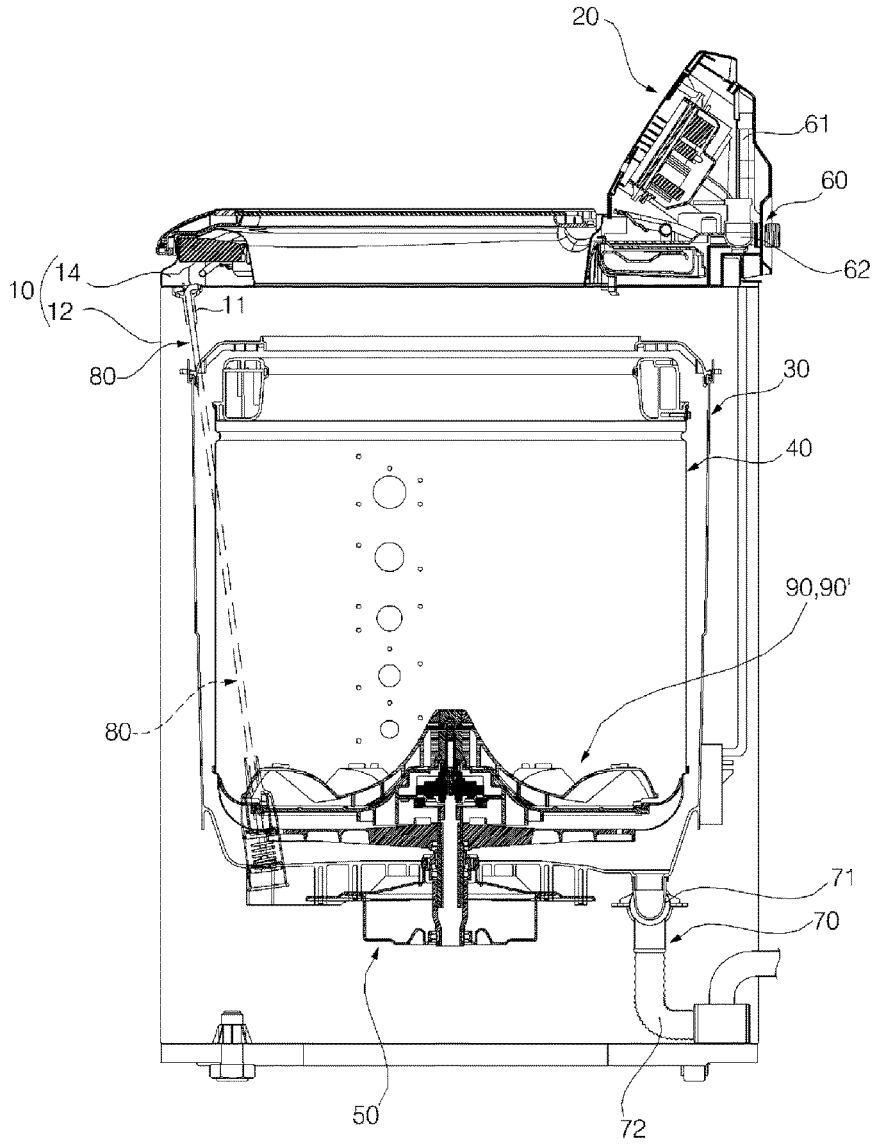
FIG. 1 is a sectional view illustrating the interior of a washing machine according to an embodiment of the present invention.

Referring to FIG. 1, a washing machine according to the present embodiment (i.e., the first embodiment or the second embodiment) includes a casing 10 defining the external appearance of the washing machine, and a control module 20 installed on casing 10.

Control module 20 includes, for example, manipulation keys for receiving manipulation force from a user, and a display for displaying information related to the state of operation of the washing machine.

The washing machine includes a tub 30 placed inside casing 10 for storing wash water therein, a drum 40 placed inside tub 30 for storing laundry to be washed, a drive module 50 placed on tub 30 for rotating drum 40 in order to wash the laundry, a water supply module 60 for supplying wash water to tub 30, a water drain module 70 for discharging wash water stored in tub 30, a suspension module 80 for reducing or absorbing vibrations generated in tub 30, and a dual pulsator 90 or 90' placed in drum 40 so as to be rotated upon receiving drive power from drive module 50.

Dual pulsator 90 or 90' is comprised of an inner pulsator 92 or 92' and an outer pulsator 94 or 94'. The axis centers of the respective pulsators 92 or 92' and 94 or 94' are located on the imaginary axis of a drive shaft of drive module 50. The respective pulsators 92 or 92' and 94 or 94' are adapted to be rotated in opposite directions.

Casing 10 includes a main body 12 in which tub 30 and drum 40 are placed, a top cover 14 located on the top side of main body 12, and a door 7 formed in top cover 14 for opening or closing the inside of casing 10.

Control module 20 includes, for example, manipulation buttons and a dial for receiving manipulation force from a user.

Control module 20 is provided with a display unit (not illustrated) for showing various pieces of information about the washing machine to the user. In the present embodiment, the display unit is located in top cover 14.

Tub 30 is connected to water supply module 60 and stores wash water supplied from water supply module 60.

Tub 30 may be connected to water drain module 70, and water drain module 70 may discharge the wash water stored in tub 30 outward.

Drum 40 is placed inside tub 30. Drum 40 is rotated upon receiving drive power from drive module 50.

Drum 40 includes a drum body 42 having a cylindrical shape, and a drum base 44 coupled to the bottom side of drum body 42.

A hub 46 is disposed on drum base 44. Drive module 50 may selectively transfer drive power to hub 46.

Drum 40 is configured to be rotated forward or in reverse relative to tub 30.

In the present embodiment, water supply module 60 includes a water supply valve 61 and a water supply path 62, which are located on top cover 14.

In the present embodiment, water drain module 70 includes a water drain valve 71 connected to tub 30, and a water drain path 72 connected to water drain valve 71.

Suspension module 80 is connected to tub 30, and reduces vibrations generated in tub 30 using at least one of elasticity or absorption.

In the present embodiment, suspension module 80 is located between casing 10 and tub 30. Suspension module 80 supports the bottom of tub 30 and hangs from top cover 14.

Figure 2:
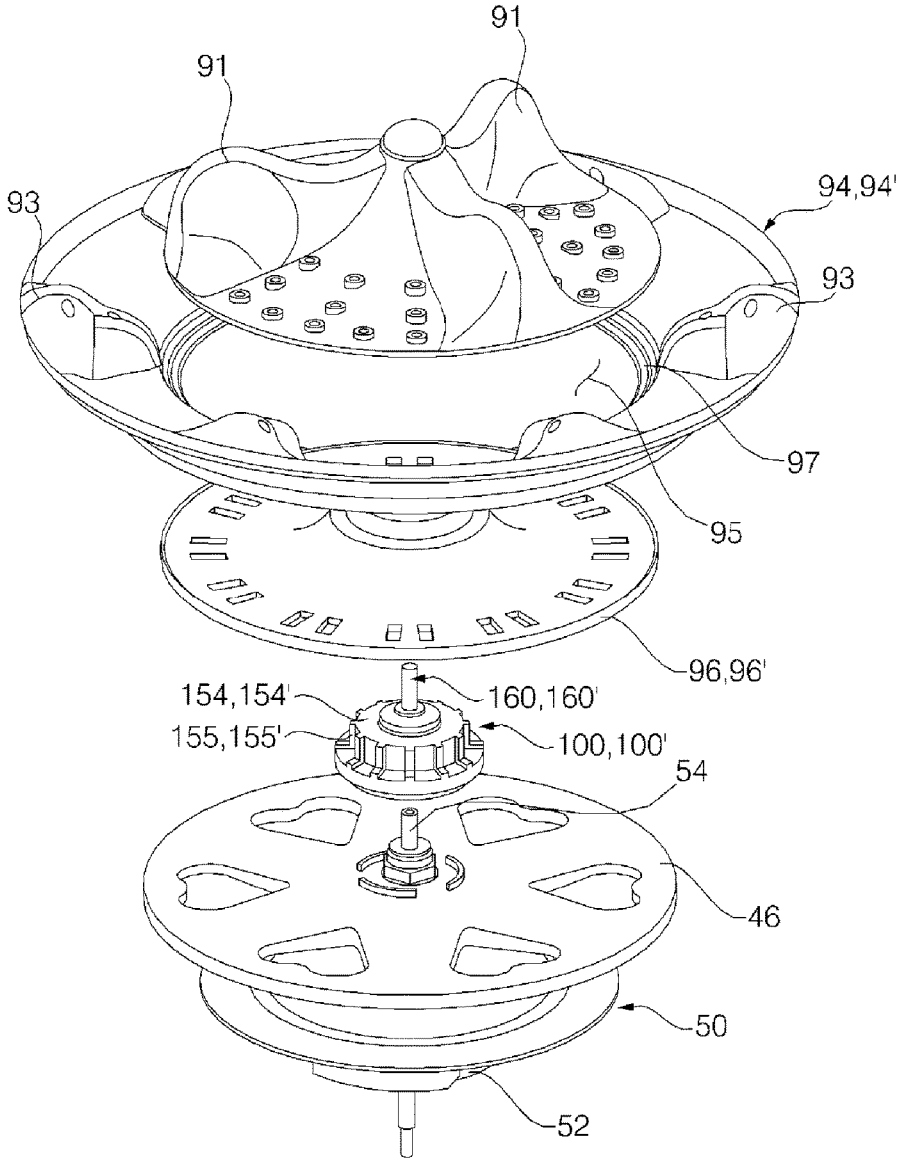
FIG. 2 is an exploded perspective view of a dual pulsator illustrated in FIG. 1.
Figure 3:
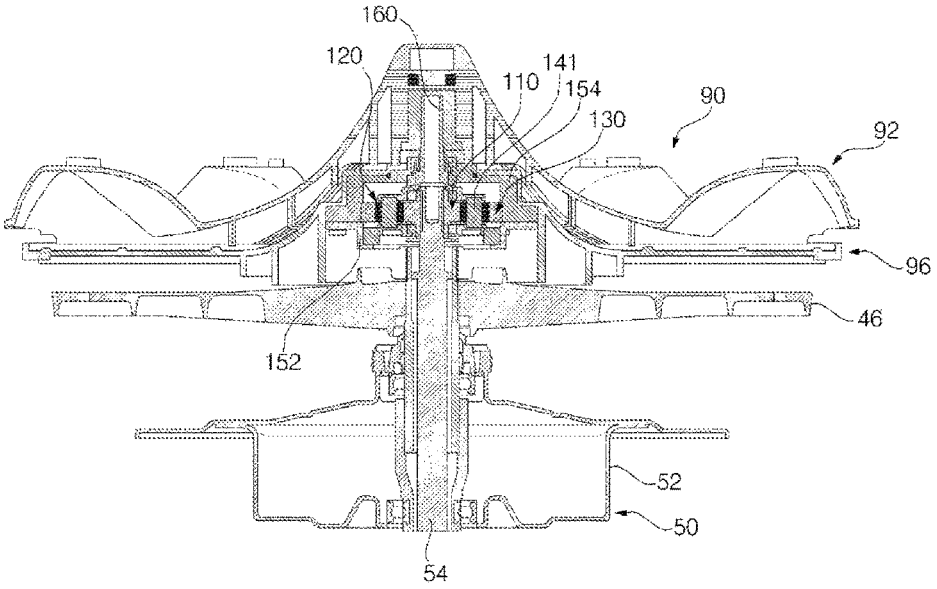
FIG. 3 is a sectional view illustrating a first embodiment of the dual pulsator illustrated in FIG. 1.
Figure 7:
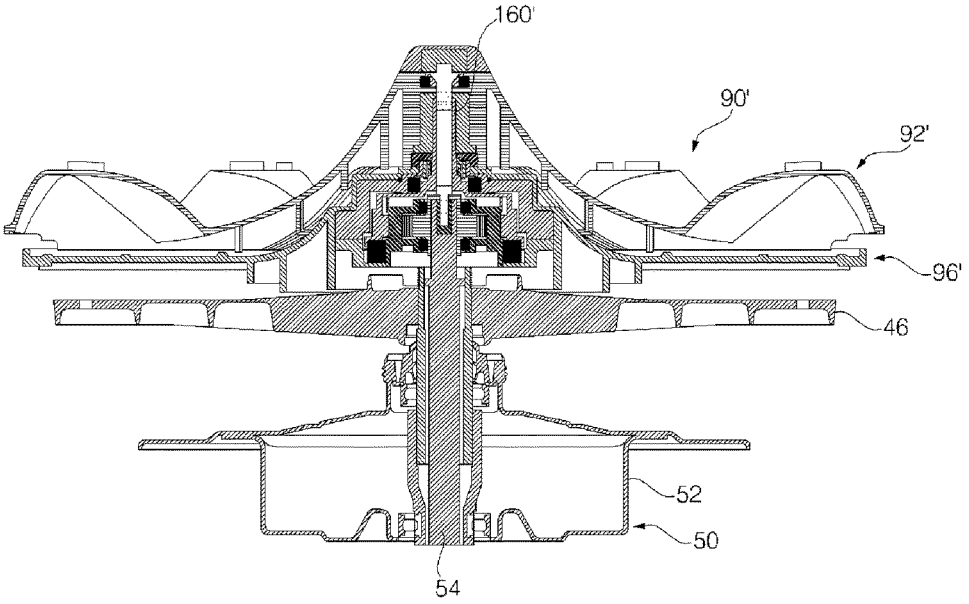
FIG. 7 is a sectional view illustrating a second embodiment of the dual pulsator illustrated in FIG. 1.

The structure of the dual pulsator 90 or 90' according to the present embodiment (i.e., the first embodiment or the second embodiment) will be described with reference to FIGS. 2, 3 and 7.

In the present embodiment, drive module 50 includes a motor 52 located on the bottom side of tub 30, a drive shaft 54 penetrating tub 30 and connected to drum 40, and a gearbox 100 or 100' for transferring drive power of drive shaft 54 to dual pulsator 90 or 90'.

Drive shaft 54 is located to penetrate hub 46.

Drive shaft 54 may be selectively connected to hub 46 of drum 40. Thus, only drum 40 may be rotated by drive module 50.

Drive shaft 54 may be selectively connected to gearbox 100 or 100'.

When drive shaft 54 and gearbox 100 or 100' are connected to each other, dual pulsator 90 or 90' may be rotated.

Dual pulsator 90 or 90' is located at the upper side of hub 46.

Dual pulsator 90 or 90' includes inner pulsator 92 or 92' and outer pulsator 94 or 94'. The inner pulsator 92 or 92' is located at the inner side of the outer pulsator 94 or 94'.

Inner pulsator 92 or 92' has a circular shape when viewed in a plan view.

Outer pulsator 94 or 94' has a ring shape when viewed in a plan view.

A rotation space or installation hole 95 in which inner pulsator 92 or 92' is rotated is defined inside outer pulsator 94 or 94'. Outer pulsator 94 or 94' includes a rotation space or installation hole 95 in the center thereof.

Inner pulsator 92 or 94' and outer pulsator 94 or 94' may be rotated in different directions from each other.

In the present embodiment, dual pulsator 90 or 90' further includes a pulsator base 96 or 96' located at lower side of inner pulsator 92 or 92'. Pulsator base 96 or 96' and outer pulsator 94 or 94' are defined as an outer assembly.

Inner pulsator 92 or 92' is located above outer pulsator 94 or 94'. Inner pulsator 92 or 92' is rotated above outer pulsator 94 or 94'.

Inner pulsator 92 or 92' may be provided with an upwardly protruding wash blade 91. In the present embodiment, three wash blades 91 are arranged at an angular interval of 120 degrees when viewed in a plan view.

Outer pulsator 94 or 94' may also be provided with an upwardly protruding wash blade 93. In the present embodiment, six wash blades 93 are equidistantly arranged when viewed in a plan view.

Inner pulsator 92 or 92' is located on the center of outer pulsator 94 or 94' when viewed in a plan view. Rotation centers of inner pulsator 92 or 92' and outer pulsator 94 or 94' are located on drive shaft 54.

Installation hole (rotation space) 95 is defined inside outer pulsator 94 or 94'. An installation groove 97 is formed in the inner edge of outer pulsator 94 or 94' defining installation hole (rotation space) 95. A portion of inner pulsator 92 or 92' is inserted into installation groove 97.

Pulsator base 96 or 96' is located below installation hole (rotation space) 95. Pulsator base 96 or 96' covers installation hole (rotation space) 95. Pulsator base 96 or 96' is fixed to outer pulsator 94 or 94'.

Gearbox 100 or 100' of drive module 50 is located below pulsator base 96 or 96'. Gearbox 100 or 100' located between pulsator base 96 or 96' and hub 46. Gearbox 100 or 100' penetrates pulsator base 96 or 96' and is connected to inner pulsator 92 or 92'.

Gearbox 100 or 100' is connected to motor 52 of drive module 50 and receives drive power. Drive shaft 54 of drive module 50 is also connected to gearbox 100 or 100'.

Gearbox 100 or 100' is connected to each of inner pulsator 92 or 92' and outer pulsator 94 or 94'. Gearbox 100 or 100' may be selectively connected to motor 52.

Gearbox 100 or 100' may receive drive power of motor 52 and transfer the drive power to inner pulsator 92 or 92' and outer pulsator 94 or 94'.

Gearbox 100 or 100' rotates inner pulsator 92 or 92' and outer pulsator 94 or 94' in opposite directions. Gearbox 100 or 100' may rotate inner pulsator 92 or 92' and outer pulsator 94 or 94' at different speeds.

Gearbox 100 or 100' may rotate inner pulsator 92 or 92' and outer pulsator 94 or 94' at different speeds depending on the size of the laundry load even if constant drive power is input from motor 52.

A configuration common to both the first embodiment and the second embodiment will now be described with reference to FIGS. 3 to 5 and FIGS. 7 to 9. Gearbox 100 or 100' includes a sun gear 110 or 110' rotatably connected to drive shaft 54 of motor 52, a plurality of planetary gears 120 or 120' rotatably engaged with sun gear 110 or 110', a ring gear 130 or 130' rotatably engaged with planetary gears 120 or 120', a carrier 140 or 140' for connecting planetary gears 120 or 120' to one another, and a gear housing 150 or 150' to which ring gear 130 or 130' is fixed, sun gear 110 or 110', planetary gears 120 or 120' and carrier 140 or 140' being placed inside gear housing 150 or 150'.

Sun gear 110 or 110', planetary gears 120 or 120', ring gear 130 or 130', and carrier 140 or 140' are defined as a planetary gear assembly. The constituent elements of the planetary gear assembly are engaged with or coupled to each other, and therefore may be systematically operated when sun gear 110 or 110' is rotated.

In the present embodiment, carrier 140 or 140' is operated in a non-constrained free state.

Sun gear 110 or 110' is coupled to drive shaft 54. Sun gear 110 or 110' is provided on inner and outer sides thereof with gear teeth.

Sun gear 110 or 110' has a sun gear bore 111 or 111' vertically formed therein. The inner circumferential surface of sun gear 110 or 110' defining sun gear bore 111 or 111' is provided with inner teeth 112 or 112'. Outer teeth 114 or 114' are formed on the outer circumferential surface of sun gear 110 or 110'.

Drive shaft 54 is inserted into sun gear bore 111 or 111'. Drive shaft 54 is engaged with inner teeth 112 or 112'. Drive shaft 54 has a serrated shape.

Planetary gears 120 or 120' are arranged around sun gear 110 or 110'.

Planetary gears 120 or 120' may rotate on their axes while rotating along the circumference of sun gear 110 or 110'. To rotate on its axis, each planetary gear 120 or 120' has a planetary gear bore 121 or 121' vertically formed therein.

Planetary gear 120 or 120' may rotate about planetary gear bore 121 or 121'. In addition, planetary gear 120 or 120' may rotate along outer teeth 114 or 114' of sun gear 110 or 110'.

In the present embodiment, six planetary gears 120 or 120' are arranged. Each planetary gear 120 or 120' is engaged with outer teeth 114 or 114' of sun gear 110 or 110'. Sun gear 110 or 110' and planetary gears 120 or 120' are horizontally arranged.

In the present embodiment, any one of inner pulsator 92 or 92' and outer pulsator 94 or 94' is connected to carrier 140 or 140' so as to rotate at the same speed and direction as carrier 140 or 140', and the other one of inner pulsator 92 or 92' and outer pulsator 94 or 94' is connected to ring gear 130 or 130' so as to rotate at the same speed and direction as ring gear 130 or 130'. Planetary gears 120 or 120', carrier 140 or 140' and ring gear 130 or 130', excluding sun gear 110 or 110', are arranged in the free state. Planetary gears 120 or 120', carrier 140 or 140' and ring gear 130 or 130' are arranged so as to be rotatable relative to drum 40.

In the present embodiment, drive shaft 54 supports sun gear 110 or 110'. Sun gear 110 or 110' supports planetary gears 120 or 120', carrier 140 or 140' and ring gear 130 or 130'. Carrier 140 or 140' supports any one of inner pulsator 92 or 92' and outer pulsator 94 or 94', and a component 150 or 130' supports the other one of inner pulsator 92 or 92' and outer pulsator 94 or 94'.

Figure 4:
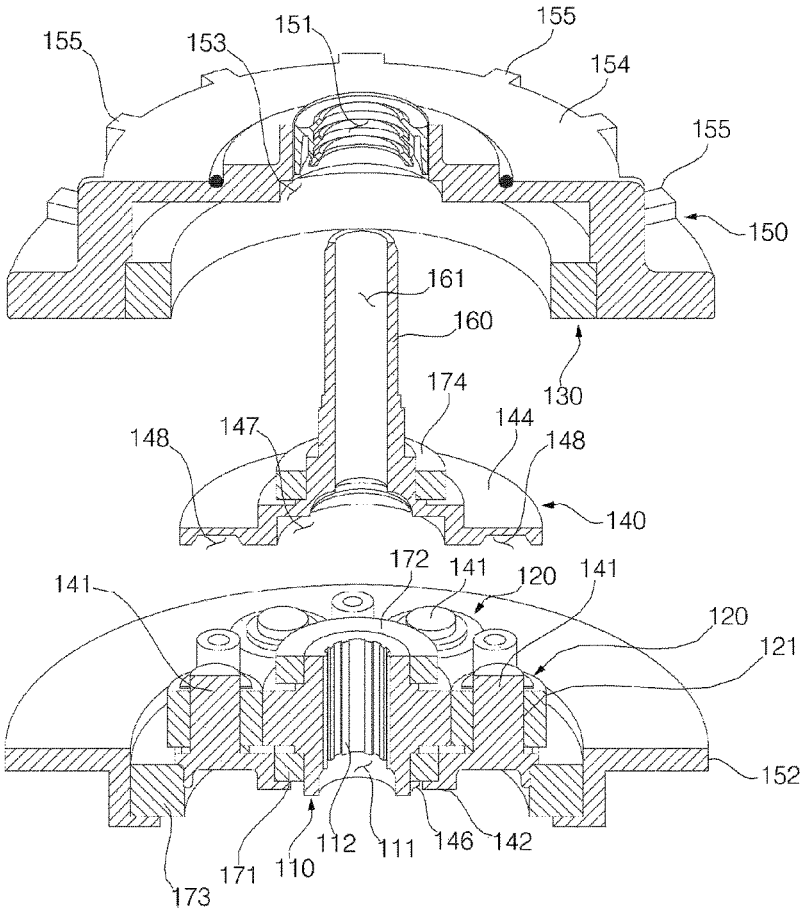
FIG. 4 is a sectional exploded perspective view of a gearbox 100 illustrated in FIG. 3.
Figure 5:
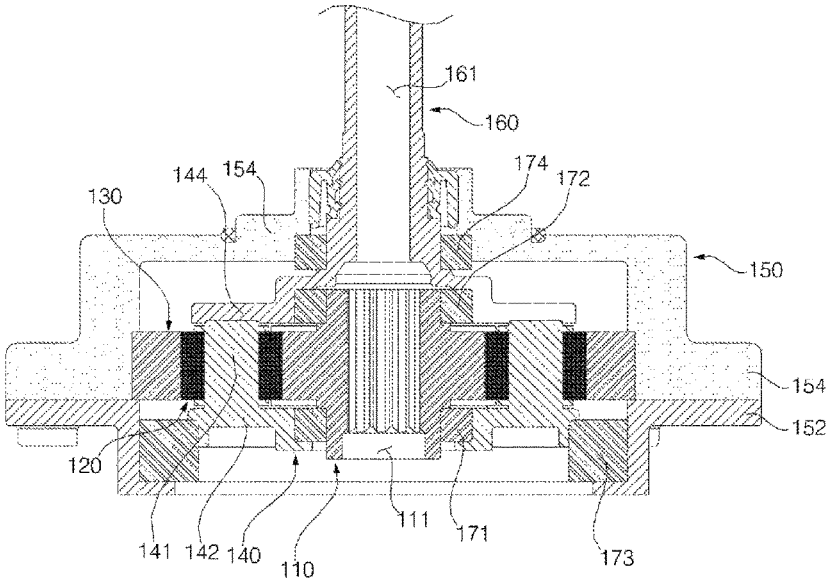
FIG. 5 is a sectional view of the gearbox 100 illustrated in FIG. 3.

The first embodiment will now be described with reference to FIGS. 3 to 5.

In the first embodiment, inner pulsator 92 is connected to carrier 140 so as to rotate at the same speed and direction as carrier 140, and outer pulsator 94 is connected to ring gear 130 so as to rotate at the same speed and direction as ring gear 130.

Ring gear 130 is located at the outer side of planetary gears 120.

In the first embodiment, ring gear 130 is fixed inside gear housing 150.

Ring gear 130 has a ring shape. Ring gear 130 has teeth formed on the inner circumferential surface thereof. Ring gear 130 is engaged with all of planetary gears 120 at the same time.

Planetary gears 120 are located between ring gear 130 and sun gear 110, and are simultaneously engaged with ring gear 130 and sun gear 110.

Carrier 140 connects planetary gears 120 to one another. Planetary gears 120 may be rotated at the same speed by carrier 140.

Carrier 140 includes a lower carrier body 142, an upper carrier body 144, and a carrier shaft 160 formed on upper carrier body 144 so as to penetrate gear housing 150 and be coupled to inner pulsator 92.

Sun gear 110 and planetary gears 120 are located between upper carrier body 144 and lower carrier body 142.

Lower carrier body 142 is located below planetary gears 120.

Upper carrier body 144 is located above planetary gears 120.

In the first embodiment, a planetary gear shaft 141 is formed on lower carrier body 142. Planetary gear shaft 141 is inserted into planetary gear bore 121. Planetary gear 120 rotates about planetary gear shaft 141.

A plurality of planetary gear shafts 141 is arranged on lower carrier body 142 in a circumferential direction. Planetary gear shafts 141 are equidistantly arranged in the circumferential direction.

Sun gear 110 is also located above lower carrier body 142. Sun gear 110 is rotated above lower carrier body 142.

Lower carrier body 142 is provided with a lower sun gear recess 146, into which sun gear 110 is inserted. Drive shaft 54 is also inserted through lower sun gear recess 146. Drive shaft 54, inserted through lower sun gear recess 146, is coupled to sun gear 110.

Upper carrier body 144 is located above lower carrier body 142. Sun gear 110 supports upper carrier body 144. Upper carrier body 144 and lower carrier body 142 are coupled to each other.

Upper carrier body 144 has an upper sun gear recess 147 formed in the lower surface thereof, into which a portion of sun gear 110 is inserted. Upper carrier body 144 further has a planetary gear shaft recess 148 formed in the lower surface thereof, into which planetary gear shaft 141 is inserted.

Upper sun gear recess 147 and lower sun gear recess 146 house bearings 172 and 171 for reducing friction of sun gear 110.

Upper carrier body 144 and lower carrier body 142 are assembled with each other and operate integrally with each other.

Carrier shaft 160 protrudes upward from upper carrier body 144. Inner pulsator 92 is rotatably connected to carrier shaft 160.

Carrier shaft 160 has a carrier shaft bore 161 formed therein. Carrier shaft bore 161 is formed in the center of carrier shaft 160.

Carrier shaft 160 penetrates gear housing 150 and protrudes upward from gear housing 150.

Although two separate carrier bodies are fabricated in the first embodiment, a single carrier body may be fabricated. When the single carrier body is fabricated, all of planetary gear shafts 141 and carrier shaft 160 are formed on single carrier body.

Gear housing 150 is comprised of a lower housing 152 and an upper housing 154.

Ring gear 130 may be fixed to one of lower housing 152 and upper housing 154.

In the first embodiment, ring gear 130 is fixed to the inner surface of upper housing 154. Upper housing 154 has a carrier shaft hole 151, through which carrier shaft 160 penetrates.

When torque is transferred to ring gear 130, gear housing 150 is rotated along with ring gear 130.

In the first embodiment, gear housing 150 is connected to outer pulsator 94. Gear housing 150 rotates outer pulsator 94.

In order to transfer torque of gear housing 150 to outer pulsator 94, upper housing 154 is provided with a housing holding protrusion 155.

Outer pulsator 94 is coupled to housing holding protrusion 155. Housing holding protrusion 155 may interfere with outer pulsator 94 and may transfer torque to outer pulsator 94 via interference therebetween.

In the first embodiment, housing holding protrusion 155 is configured to vertically protrude. Outer pulsator 94 is vertically coupled to housing holding protrusion 155 and is horizontally caught by housing holding protrusion 155.

Outer pulsator 94 and housing holding protrusion 155 may be formed in various directions and shapes.

In addition, outer pulsator 94 and gear housing 150 may be coupled to each other via any of various methods. For example, outer pulsator 94 and gear housing 150 may be hook-coupled to each other. Outer pulsator 94 and gear housing 150 may be fastened and coupled to each other.

For rotation of sun gear 110, planetary gears 120, carrier 140 and gear housing 150, in the first embodiment, bearings are arranged.

A first bearing 171 may be located between sun gear 110 and lower carrier body 142. First bearing 171 may be located in lower sun gear recess 146.

A second bearing 172 may be located between sun gear 110 and upper carrier body 144. Second bearing 172 may be located in upper sun gear recess 147. First bearing 171 and second bearing 172 minimize friction to enable the efficient rotation of sun gear 110.

A third bearing 173 may be located between lower carrier body 142 and lower housing 152. Third bearing 173 minimizes friction to enable the efficient rotation of lower carrier body 142 and gear housing 150.

A fourth bearing 174 may be located between upper carrier body 144 and upper housing 154. Fourth bearing 174 may be located between carrier shaft 160 and upper housing 154. Fourth bearing 174 is inserted into and installed in upper housing 154. Upper housing 154 is provided with a bearing recess 153, into which fourth bearing 174 is inserted. In the first embodiment, bearing recess 153 and carrier shaft hole 151 are connected to each other. The diameter of bearing recess 153 is greater than diameter of carrier shaft hole 151. Fourth bearing 174 minimizes friction to enable the efficient rotation of upper carrier body 144 or carrier shaft 160.

In the first embodiment, first bearing 171 is placed on carrier 140. First bearing 171 is placed on lower carrier body 142.

Second bearing 172 is installed to downwardly apply pressure to sun gear 110.

Lower carrier body 142 and upper carrier body 144 apply pressure to sun gear 110 through first bearing 171 and second bearing 172.

Sun gear 110 is fitted and installed between lower carrier body 142 and upper carrier body 144 and is rotatable only in horizontal direction.

In the first embodiment, third bearing 173 is placed on lower housing 152. In addition, carrier 140 is placed on third bearing 173.

Fourth bearing 174 is fitted and installed between upper housing 154 and upper carrier body 144.

When upper housing 154 and lower housing 152 are assembled with each other, fourth bearing 174 and third bearing 173 support gear housing 150.

In the first embodiment, drive shaft 54 supports sun gear 110. Sun gear 110 supports planetary gears 120 and carrier 140. Carrier 140 supports gear housing 150. Carrier 140 supports inner pulsator 92. Gear housing 150 supports outer pulsator 94.

Figure 8:
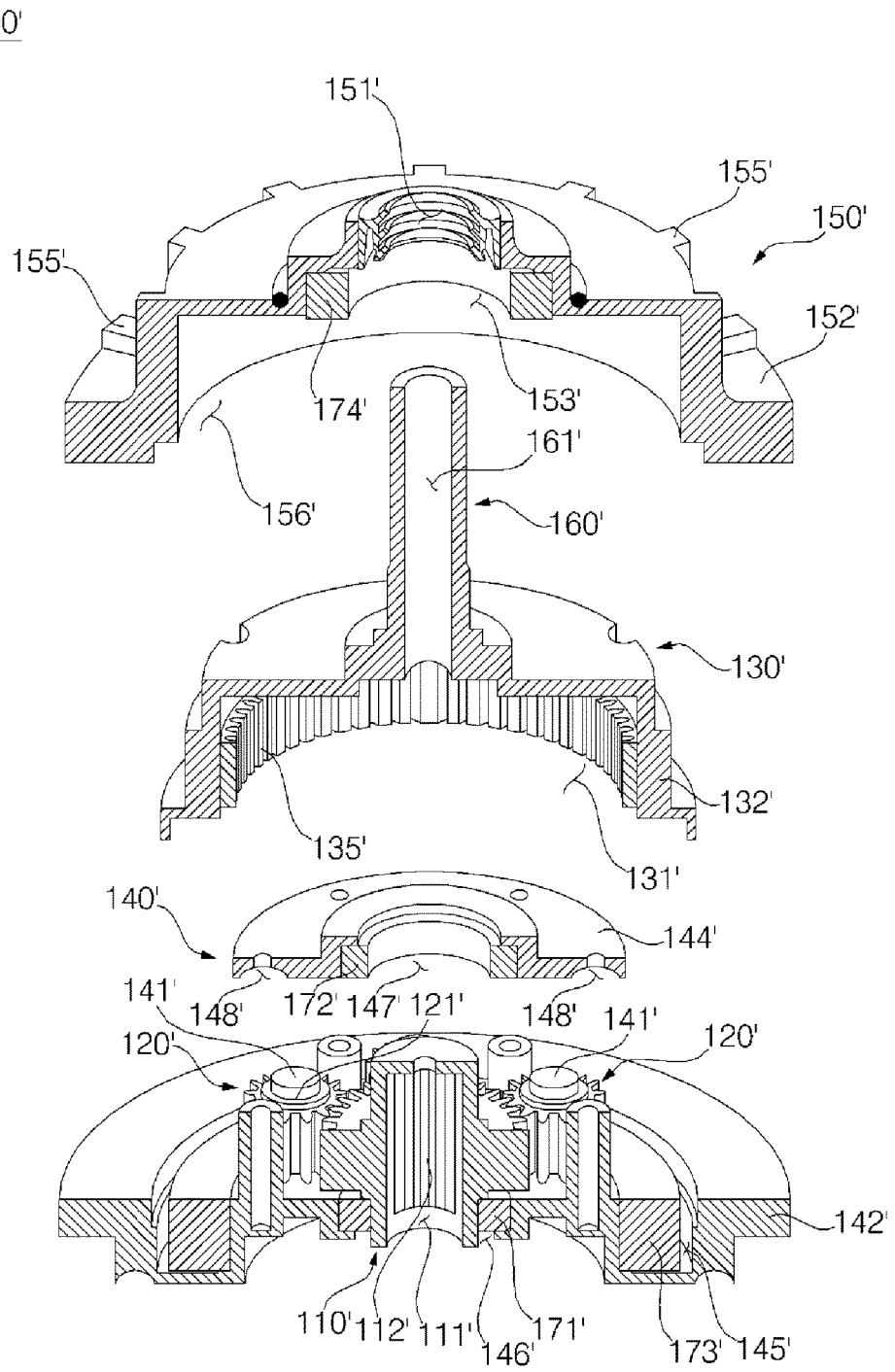
FIG. 8 is a sectional exploded perspective view of a gearbox 100' illustrated in FIG. 7.
Figure 9:
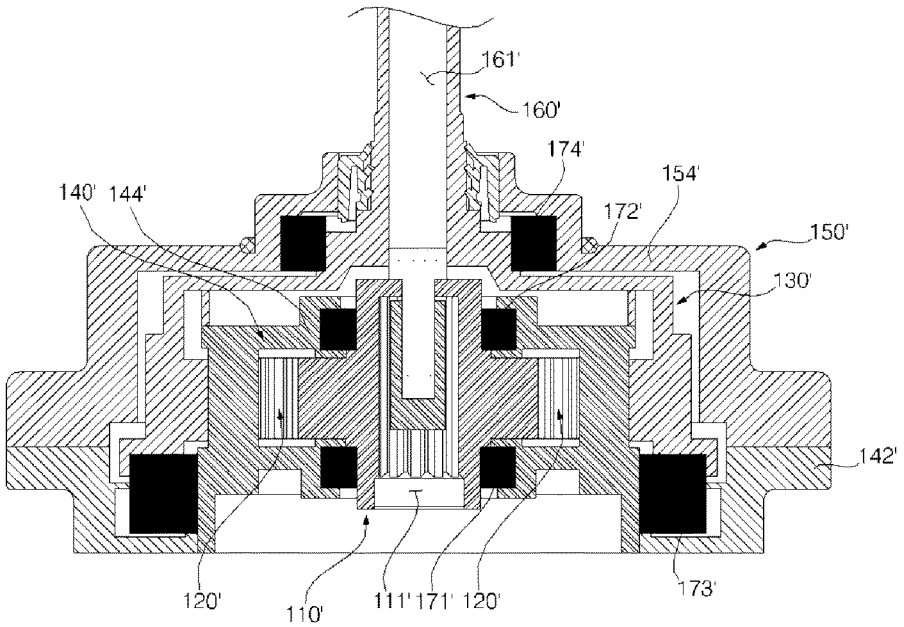
FIG. 9 is a sectional view of the gearbox 100' illustrated in FIG. 7.

Now, the second embodiment will be described with reference to FIGS. 7 to 9.

In the second embodiment, outer pulsator 94' is connected to carrier 140' so as to rotate at the same speed and direction as carrier 140', and inner pulsator 92' is connected to ring gear 130' so as to rotate at the same speed and direction as ring gear 130'.

Ring gear 130' is connected to inner pulsator 92'. Ring gear 130' transfers torque to inner pulsator 92'. Ring gear 130' is located at the outer side of planetary gears 120' and is engaged with planetary gears 120'. Ring gear 130' is formed to surround planetary gears 120'.

In the second embodiment, ring gear 130' has an open bottom side.

Ring gear 130' covers the top side of sun gear 110', planetary gears 120', and carrier 140'. Sun gear 110', planetary gears 120', and carrier 140' may be located inside ring gear 130'.

Ring gear 130' defines therein a ring gear space 131' in which sun gear 110', planetary gears 120', and carrier 140' are accommodated.

Ring gear 130' has ring gear teeth 135' formed on the inner circumferential surface thereof so as to be engaged with planetary gears 120'.

Ring gear 130' includes a ring gear body 132' having an open bottom side, ring gear body 132' defining ring gear space 131' therein, ring gear teeth 135' formed on the inner circumferential surface of ring gear body 132' so as to be engaged with planetary gears 120', and a ring gear shaft 160' protruding upward from ring gear body 132' so as to be coupled to inner pulsator 92'.

A ring gear shaft bore 161' is vertically formed in ring gear shaft 160' and extends a long length. Ring gear shaft bore 161' and ring gear space 131' may communicate with each other.

Ring gear 130' may be rotated in a direction opposite to that of carrier 140'.

Planetary gears 120' are located between ring gear 130' and sun gear 110', and are simultaneously engaged with ring gear 130' and sun gear 110'.

Carrier 140' connects planetary gears 120' to one another. Planetary gears 120' may be rotated at the same speed by carrier 140'.

Carrier 140' transfers torque to outer pulsator 94'. In the second embodiment, carrier 140' is coupled to gear housing 150'. As such, torque of carrier 140' is transferred to outer pulsator 94' through gear housing 150'.

Carrier 140' includes an upper carrier body 144' placed above sun gear 110' and planetary gears 120', a lower carrier body 142' placed below sun gear 110' and planetary gears 120' supported by sun gear 110' and planetary gears 120', and a planetary gear shaft 141' formed on at least one of upper carrier body 144' and lower carrier body 142' so as to allow each planetary gear 120' to rotate about planetary gear shaft 141'.

Sun gear 110' and planetary gears 120' are located between upper carrier body 144' and lower carrier body 142'.

Lower carrier body 142' is located below planetary gears 120'.

Upper carrier body 144' is located above planetary gears 120'.

In the second embodiment, planetary gear shaft 141' is formed on lower carrier body 142'. Planetary gear shaft 141' is inserted into planetary gear bore 121'. Planetary gear 120' rotates about planetary gear shaft 141'.

A plurality of planetary gear shafts 141' is arranged on lower carrier body 142' in a circumferential direction. Planetary gear shafts 141' are equidistantly arranged in circumferential direction.

Sun gear 110' is also located above lower carrier body 142'. Sun gear 110' is rotated above lower carrier body 142'.

Lower carrier body 142' is provided with a lower sun gear recess 146', into which sun gear 110' is inserted. Drive shaft 54 is also inserted through lower sun gear recess 146'. Drive shaft 54, inserted through lower sun gear recess 146', is coupled to sun gear 110'.

Upper carrier body 144' is located above lower carrier body 142'. Sun gear 110' supports upper carrier body 144'. Upper carrier body 144' and lower carrier body 142' are coupled to each other.

Upper carrier body 144' has an upper sun gear recess 147' formed in the lower surface thereof, into which a portion of sun gear 110' is inserted. Upper carrier body 144' further has a planetary gear shaft recess 148' formed in the lower surface thereof, into which planetary gear shaft 141' is inserted.

Upper sun gear recess 147' and lower sun gear recess 146' house bearings 172' and 171' for reducing friction of sun gear 110.

Upper carrier body 144' and lower carrier body 142' are assembled with each other and operate integrally with each other.

Although two separate carrier bodies are fabricated in the second embodiment, a single carrier body may be fabricated.

Gear housing 150' is connected to outer pulsator 94'. Outer pulsator 94' is rotated via rotation of gear housing 150'.

Gear housing 150' has an open bottom side. Gear housing 150' defines a housing space 156' therein. Ring gear 130' is inserted into housing space 156'.

Gear housing 150' is provided with a ring gear shaft hole 151', through which ring gear shaft 160' penetrates.

In order to transfer torque of gear housing 150' to outer pulsator 94', gear housing 150' is provided with a housing holding protrusion 155'.

Outer pulsator 94' is coupled to housing holding protrusion 155'. Housing holding protrusion 155' may interfere with outer pulsator 94' and may transfer torque to outer pulsator 94' via interference therebetween.

In the second embodiment, housing holding protrusion 155' is configured to vertically protrude. Outer pulsator 94' is vertically coupled to housing holding protrusion 155' and is horizontally caught by housing holding protrusion 155'.

Outer pulsator 94' and housing holding protrusion 155' may be formed in various directions and shapes.

In addition, outer pulsator 94' and gear housing 150' may be coupled to each other via any of various methods. For example, outer pulsator 94' and gear housing 150' may be hook-coupled to each other. Outer pulsator 94' and gear housing 150' may be fastened and coupled to each other.

For rotation of sun gear 110', planetary gears 120', carrier 140' and gear housing 150', in second embodiment, bearings are arranged.

A first bearing 171' may be located between sun gear 110' and lower carrier body 142'. First bearing 171' may be located in lower sun gear recess 146'.

A second bearing 172' may be located between sun gear 110' and upper carrier body 144'. Second bearing 172' may be located in upper sun gear recess 147'. First bearing 171' and second bearing 172' minimize friction to enable efficient rotation of sun gear 110'.

A third bearing 173' may be located between lower carrier body 142' and ring gear body 132'. Third bearing 173' minimizes friction when ring gear 130' and carrier 140' are rotated.

Lower carrier body 142' is provided with a bearing groove 145' into which third bearing 173' is inserted. Bearing groove 145' has a ring shape.

A portion of lower side of ring gear 130' comes into contact with third bearing 173'. Third bearing 173' may be located in ring gear space 131' of ring gear 130'. That is, third bearing 173' supports ring gear 130' outwardly from ring gear space 131'

A fourth bearing 174' may be located between ring gear 130' and gear housing 150'. Fourth bearing 174' may be located between ring gear shaft 160' and gear housing 150'. Fourth bearing 174' is inserted into and installed in gear housing 150'. Gear housing 150' is provided with a bearing recess 153', into which fourth bearing 174' is inserted. In the second embodiment, housing space 156', bearing recess 153' and ring gear shaft hole 151' are connected to each other. The diameter of bearing recess 153' is greater than the diameter of ring gear shaft hole 151'.

Fourth bearing 174' minimizes friction to enable the efficient rotation of ring gear shaft 160' and gear housing 150'.

In the second embodiment, first bearing 171' is placed on carrier 140'. First bearing 171' is placed on lower carrier body 142'.

Second bearing 172' is installed to downwardly apply pressure to sun gear 110'.

Lower carrier body 142' and upper carrier body 144' apply pressure to sun gear 110' through first bearing 171' and second bearing 172'.

Sun gear 110' is fitted and installed between lower carrier body 142' and upper carrier body 144' and is rotatable only in the horizontal direction.

Fourth bearing 174' is fitted and installed between ring gear shaft 160' and gear housing 150'.

In the second embodiment, drive shaft 54 supports sun gear 110'. Sun gear 110' supports planetary gears 120', carrier 140' and gear housing 150'. Gear housing 150' supports ring gear body 132'. Gear housing 150' supports outer pulsator 94. Ring gear body 132' supports inner pulsator 92.

Hereinafter, the operating process of the dual pulsator according to the present embodiment (i.e. the first embodiment or the second embodiment) will be described in more detail with reference to the accompanying drawings.

First, when power is applied to drive module 50 and motor 52 is operated, drive shaft 54 is rotated. When drive shaft 54 is rotated, sun gear 110 or 110' connected to drive shaft 54 is rotated.

Drive shaft 54 may be rotated clockwise or counterclockwise via operation of motor 52.

For convenience of description, the direction in which drive shaft 54 is rotated is defined as a forward direction, and the rotation direction opposite to the forward direction is defined as a reverse direction.

Sun gear 110 or 110', which is directly connected to drive shaft 54, is rotated in the forward direction.

Because planetary gears 120 or 120' come into contact with the outer circumference of sun gear 110 or 110' and are engaged with sun gear 110 or 110', planetary gears 120 or 120' are rotated in the direction opposite to the rotation direction of sun gear 110 or 110'. That is, planetary gears 120 or 120' are rotated in the reverse direction.

Here, carrier 140 or 140', which connects planetary gears 120 or 120' to one another, is rotated in the forward direction opposite to the rotation direction of planetary gears 120 or 120'. That is, sun gear 110 or 110' and carrier 140 or 140' are rotated in the same direction.

Each planetary gear 120 or 120' rotates about planetary gear shaft 141 or 141' and rotates along the outer circumference of sun gear 110 or 110'. Planetary gear 120 or 120' is not fixed, but is free, thus receiving repulsive force when engaged with ring gear 130 or 130'.

Thus, ring gear 130 or 130' is rotated in the reverse direction opposite to the rotation direction of carrier 140 or 140'.

In this way, carrier 140 or 140' and ring gear 130 or 130' according to the present embodiment are rotated in opposite directions.

In the present embodiment, carrier 140 or 140' rotates outer pulsator 94 or 94' via gear housing 150 or 150', and ring gear 130 or 130' rotates inner pulsator 92 or 92' via shaft 160 or 160'.

As such, when sun gear 110 or 110' is rotated, inner pulsator 92 or 92' and outer pulsator 94 or 94' may be rotated in opposite directions.

The present embodiment has a feature by which carrier 140 or 140' is in a free state rather than being constrained. Because carrier 140 or 140' is in the free state, the rotation speed of carrier 140 or 140' may vary depending on the load applied to inner pulsator 92 or 92' or outer pulsator 94 or 94'.

In the present embodiment, torque is input to only sun gear 110 or 110', and all of planetary gears 120 or 120', carrier 140 or 140' and ring gear 130 or 130' are in the free state.

Thus, the rotation speed of inner pulsator 92 or 92' or the rotation speed of outer pulsator 94 or 94' relative to drum 40 may vary depending on the load applied to inner pulsator 92 or 92' or outer pulsator 94 or 94'.

For example, inner and outer pulsators 92 or 92' and 94 or 94' may be rotated relative to drum 40 at different speeds depending on whether a large load of laundry is located on inner pulsator 92 or 92' or outer pulsator 94 or 94'. In addition, the rotation speeds of the inner and outer pulsators 92 or 92' and 94 or 94' relative to drum 40 may vary depending on the load even when laundry is located on both inner pulsator 92 or 92' and outer pulsator 94 or 94'.

When inner pulsator 92 or 94' and outer pulsator 94 or 94' are rotated in opposite directions and the rotation speeds thereof vary as described above, the washing effect may be maximized. For example, an operation of twisting, rubbing, or squeezing laundry may be realized. In particular, because the speeds vary depending on the size of the laundry load, damage to the laundry may be reduced.

When the pulsator is operated at a high speed in the case of a large load of laundry as in the related art, the laundry may be damaged due to excess friction. In the washing machine according to the present embodiment, inner pulsator 92 or 92' or outer pulsator 94 or 94' may be rotated relative to drum 40 at a low speed under the condition of a high load, and may be rotated relative to drum 40 at a high speed under the condition of a low load.

Figure 6:
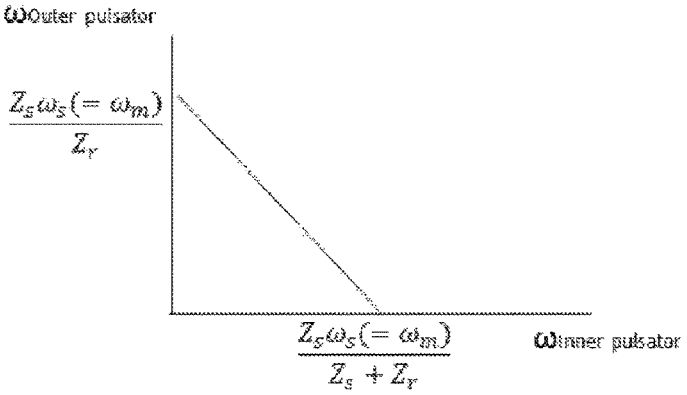
FIG. 6 is a graph illustrating the speed of a planetary gear assembly according to the first embodiment.

In the first embodiment, the rotation speeds of inner pulsator 92 and outer pulsator 94 are described by Graph 1 of FIG. 6. In the first embodiment, the rotation speed $W_{inner\ pulsator}$ of inner pulsator 92 is represented by the following equation 1:

$$W_{Inner\ pulsator} = \frac{w_s Z_s - w_{Outer\ pulsator} Z_r}{Z_s + Z_r}$$

where, $W_s$: the rotation speed of the sun gear $W_m$: the rotation speed of the motor ($W_m - W_s$)

$W_r$: the rotation speed of the ring gear $W_{outer\ pulsator}$: the rotation speed of the outer pulsator ($W_{outer\ pulsator} = W_r$)

Figure 10:
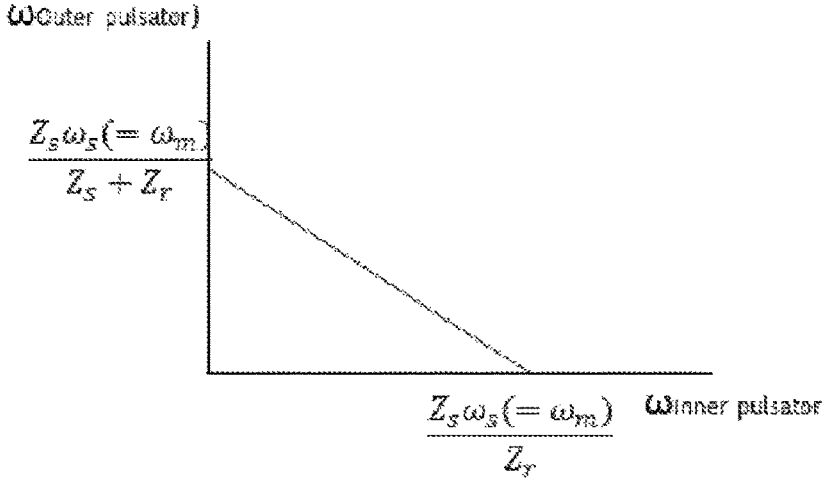
FIG. 10 is a graph illustrating the speed of a planetary gear assembly according to the second embodiment.

$Z_s$: the number of teeth of the sun gear $Z_r$: the number of teeth of the ring gear In the second embodiment, the rotation speeds of inner pulsator 92' and outer pulsator 94' are described by Graph 2 of FIG. 10. In the second embodiment, the rotation speed $W_{outer\ pulsator}$ of outer pulsator 94' is represented by the following equation 2:

$$W_{Outer\ pulsator} = \frac{w_s Z_s - w_{Inner\ pulsator} Z_r}{Z_s + Z_r}$$

where, $W_s$: the rotation speed of the sun gear $W_m$: the rotation speed of the motor ($W_m - W_s$)

$W_r$: the rotation speed of the ring gear $W_{inner\ pulsator}$: the rotation speed of the inner pulsator ($W_{inner\ pulsator} = W_r$)

$Z_s$: the number of teeth of the sun gear $Z_r$: the number of teeth of the ring gear In the present embodiment (i.e. the first embodiment or the second embodiment), because sun gear 110 or 110' and drive shaft 54 are directly connected to each other, the rotation speed of the motor and the rotation speed of the sun gear are the same.

In the first embodiment, because gear housing 150 to which ring gear 130 is fixed and outer pulsator 94 are directly connected to each other, the rotation speed of ring gear 130 and the rotation speed of outer pulsator 94 are the same.

In the second embodiment, because gear housing 150' to which ring gear 130' is fixed and inner pulsator 92' are directly connected to each other, rotation speed of ring gear 130' and the rotation speed of inner pulsator 92' are the same.

In the present embodiment (i.e. the first embodiment or the second embodiment), the number of teeth of sun gear 110 or 110' is 110, the number of teeth of planetary gear 120 or 120' is 20, and the number of teeth of ring gear 130 or 130' is 80.

In the first embodiment, analyzing Graph 1 based on the above equation 1, the rotation speed $W_{inner\ pulsator}$ of inner pulsator 92 is within the range from 0 to ⅓ $W_m$ (the rotation speed of the motor), and the rotation speed $W_{outer\ pulsator}$ of outer pulsator 94 is within the range from 0 to ½ $W_m$ (the rotation speed of the motor).

In the second embodiment, analyzing Graph 2 based on the above equation 2, the rotation speed $W_{inner\ pulsator}$ of inner pulsator 92' is within the range from 0 to ⅓ $W_m$ (the rotation speed of the motor), and the rotation speed $W_{outer\ pulsator}$ of outer pulsator 94' is within the range from 0 to ½ $W_m$ (the rotation speed of the motor).

As is apparent from the above description, a top-loading-type washing machine according to the present invention has an advantage of achieving excellent washing performance because an inner pulsator and an outer pulsator are rotated in opposite directions.

The top-loading-type washing machine according to the present invention has an advantage in that the rotation speeds of the inner pulsator and the outer pulsator are variable depending on the size of the laundry load.

The top-loading-type washing machine according to the present invention has an advantage of reducing power consumption because the rotation speeds of the inner pulsator and the outer pulsator are variable depending on the size of the laundry load.

The top-loading-type washing machine according to the present invention has an advantage of reducing damage to laundry because the rotation speeds of the inner pulsator and the outer pulsator are reduced under the condition of a high load.

The top-loading-type washing machine according to the present invention has an advantage of varying the rotation speeds of the inner pulsator and the outer pulsator relative to a drum depending on the size of the laundry load.

What is claimed is:

1. A top-loading-type washing machine comprising:

a drum;

a drive module for rotating the drum via a drive shaft;

an inner pulsator located on the drive shaft, the inner pulsator being rotated by torque from the drive module;

an outer pulsator located at an outer side of the inner pulsator, the outer pulsator being rotated by torque from the drive module; and a gearbox connected to the drive shaft to receive torque from the drive module, the gearbox rotating the inner pulsator and the outer pulsator in opposite directions, wherein the gearbox includes:

a sun gear connected to and rotating with the drive shaft;

a plurality of planetary gears engaged with the sun gear, each of the planetary gears rotating on its own axis while traveling along an outer circumferential surface of the sun gear;

a carrier for providing the rotation axis of each planetary gear and connecting the planetary gears to one another, the carrier being rotated along with the planetary gears when the planetary gears travel along the outer circumferential surface of the sun gear;

a ring gear engaged with the planetary gears so as to rotate; and a gear housing to which the ring gear is fixed, wherein one of the inner pulsator and the outer pulsator is connected to the carrier so as to rotate at the same speed and direction as the carrier, and a remaining one of the inner pulsator and the outer pulsator is connected to the gear housing so as to rotate at the same speed and direction as the gear housing, and wherein the planetary gears, the carrier, and the ring gear are arranged so as to be rotatable relative to the drum.

2. The top-loading-type washing machine of claim 1, wherein the outer pulsator includes a rotation space in the center thereof, and the inner pulsator is located in the rotation space, and wherein the top-loading-type washing machine further comprises a pulsator base for covering a bottom side of the rotation space.

3. The top-loading-type washing machine of claim 1, wherein the sun gear has a sun gear bore formed therein, and the drive shaft is inserted into and coupled to the sun gear bore, wherein the sun gear supports the carrier, and wherein the top-loading-type washing machine further comprises:

a bearing located between the carrier and the sun gear;

a gear housing supported by the carrier; and a bearing located between the carrier and the gear housing.

4. The top-loading-type washing machine of claim 1, wherein the inner pulsator is connected to the carrier so as to rotate, and the outer pulsator is connected to the gear housing so as to rotate.

5. The top-loading-type washing machine of claim 4, wherein the carrier includes:

an upper carrier body placed above the sun gear and the planetary gears;

a lower carrier body placed below the sun gear and the planetary gears;

a planetary gear shaft formed on at least one of the upper carrier body and the lower carrier body for providing a rotation axis of each planetary gear; and a carrier shaft formed on the upper carrier body and connected to the inner pulsator so as to transfer torque.

6. The top-loading-type washing machine of claim 5, wherein the carrier shaft is integrally formed with the upper carrier body, and wherein the carrier shaft penetrates the gear housing and is assembled with the inner pulsator.

7. The top-loading-type washing machine of claim 5, wherein the upper carrier body has an upper sun gear recess into which a portion of an upper side of the sun gear is inserted, and the lower carrier body has a lower sun gear recess into which a portion of a lower side of the sun gear is inserted, and wherein the upper sun gear recess and the lower sun gear recess house bearings for reducing friction of the sun gear.

8. The top-loading-type washing machine of claim 5, further comprising:

a bearing located between the lower carrier body and the gear housing.

9. The top-loading-type washing machine of claim 4, wherein the gear housing includes:

a lower housing placed on the outside of the sun gear, the planetary gears, and the carrier; and an upper housing placed above the lower housing and coupled to the outer pulsator, wherein the ring gear is fixed to one of the upper housing or the lower housing, wherein the upper housing has a housing holding protrusion formed on an outer surface thereof, and the housing holding protrusion is coupled to the outer pulsator, wherein the carrier includes a carrier shaft connected to the inner pulsator so as to transfer torque, and wherein the upper housing has a carrier shaft hole for penetration of the carrier shaft.

10. The top-loading-type washing machine of claim 1, wherein the gearbox further includes:

a ring gear shaft formed on the ring gear and coupled to the inner pulsator; and a gear housing to which the carrier is fixed, and wherein the inner pulsator is connected to the ring gear shaft so as to rotate, and the outer pulsator is connected to the gear housing so as to rotate.

11. The top-loading-type washing machine of claim 10, wherein the gear housing includes:

a housing body coupled to the carrier and also coupled to the outer pulsator;

a housing space formed in the housing body for insertion of the ring gear; and a ring gear shaft hole formed in the housing body for penetration of the ring gear shaft.

12. The top-loading-type washing machine of claim 10, wherein the carrier includes:

an upper carrier body placed above the sun gear and the planetary gears;

a lower carrier body placed below the sun gear and the planetary gears; and a planetary gear shaft formed on at least one of the upper carrier body and the lower carrier body for providing a rotation axis of each planetary gear.

13. The top-loading-type washing machine of claim 12, wherein at least one of the upper carrier body and the lower carrier body has a sun gear recess for insertion of the sun gear, and a bearing is located in the sun gear recess.

14. The top-loading-type washing machine of claim 12, wherein the upper carrier body has an upper sun gear recess into which a portion of an upper side of the sun gear is inserted, and the lower carrier body has a lower sun gear recess into which a portion of a lower side of the sun gear is inserted, and wherein the upper sun gear recess and the lower sun gear recess are provided respectively with bearings for reducing friction of the sun gear.

15. The top-loading-type washing machine of claim 12, wherein the gear housing includes:

a housing body coupled to the outer pulsator and also coupled to the lower carrier body;

a housing space formed in the housing body for insertion of the ring gear; and a ring gear shaft hole formed in the housing body for penetration of the ring gear shaft.

16. The top-loading-type washing machine of claim 15, wherein the housing space and the ring gear shaft hole are formed to communicate with each other, and wherein the ring gear is inserted into the housing space, and the ring gear shaft penetrates the ring gear shaft hole and is coupled to the inner pulsator.

17. The top-loading-type washing machine of claim 15, wherein the housing body has a housing holding protrusion formed on an outer surface thereof, and the housing holding protrusion is coupled to the outer pulsator.

18. The top-loading-type washing machine of claim 10, wherein the ring gear is located between the gear housing and the carrier, and is rotated in a direction opposite to that of the carrier.

19. The top-loading-type washing machine of claim 10, wherein the ring gear includes:

a ring gear body having a ring gear space formed therein; and ring gear teeth formed on an inner circumferential surface of the ring gear body so as to be engaged with the planetary gears, and wherein the ring gear shaft protrudes upward from the ring gear body.

* * * * *